US005323718A

United States Patent [19]

Scolaro et al.

[11] Patent Number: 5,323,718

[45] Date of Patent: Jun. 28, 1994

[54] OVERFIRE AIR SYSTEM FOR INCINERATING

[75] Inventors: Charles J. Scolaro, Bayville; Matthew J. Gaskin, Williston Park, both of N.Y.

[73] Assignee: Leon Industries, Inc., Deer Park, N.Y.

[21] Appl. No.: 986,858

[22] Filed: Dec. 4, 1992

[51] Int. Cl.[5] ..... F23L 15/00

[52] U.S. Cl. ..... 110/308; 110/302; 110/305; 110/314; 110/348

[58] Field of Search ..... 110/300, 302, 305, 308, 110/314, 348, 190, 336, 291

[56] References Cited

U.S. PATENT DOCUMENTS 3,995,568 12/1976 Dvirka et al. ..... 110/300

4,316,420 2/1982 Kuchey ..... 110/19 U X 4,759,297 7/1988 McNally et al. ..... 110/336 X

*Primary Examiner*—Edward G. Favors

*Attorney, Agent, or Firm*—Lalos & Keegan

[57] ABSTRACT

In an incinerator having a housing structure defining a combustion chamber provided with a pair of side walls, a stoker disposed in the combustion chamber between the side walls and an underfire air system, an overfire air system generally consisting of a first means for injecting a variable volume of air under pressure into the combustion chamber at a level above the stoker, and second means for injecting a variable volume of air under pressure into the combustion chamber at a level above the stoker, a second variable volume air injecting means including means for conveying air supplied to the combustion chamber in heat exchange relation with at least one side wall of the combustion chamber for cooling such wall.

16 Claims, 3 Drawing Sheets

OVERFIRE AIR SYSTEM FOR INCINERATING

This invention relates to large capacity incinerators such as municipal, industrial and commercial incinerators, and more particularly to an improved overfire air system for such types of incinerators.

Typically, conventional large capacity incinerators such as industrial and municipal incinerators, generally include a housing structure providing a combustion chamber having a refuse charging inlet and a residue discharging outlet, a stoker disposed in the combustion chamber on which the refuse is deposited and burned and the residue is advanced to the discharge outlet, a burner system for igniting the refuse on the stoker and a system for providing combustion air and controlling the combustion process.

The stoker in such type of incinerator typically extends the entire length of the combustion chamber between a pair of side walls, and includes sets of grates which are reciprocated to advance the refuse along the length of the stoker and to upset the refuse by agitation to enhance the burning process. The air system generally includes an underfire air system and a overfire air system. The underfire air system generally includes a number of nozzles in the side walls of the housing structure, connected to a source of air under pressure, which supply air to the combustion chamber below the burning refuse and generally the stoker grates. The overfire air system generally includes a number of nozzles in the side walls of the housing structure, also connected to a source of air under pressure, which supply air to the combustion chamber above the burning refuse.

Most efficiently, incinerators of this type are operated at temperatures in the range of 1,600° F. to 1,800° F. Operating within such temperature range provides the combustion of most constituents of typical refuse yet avoids the melting of various solid particles which could be deposited as slag on the side walls of the combustion chamber. Conventionally, the temperature of the combustion chamber is controlled by controlling the amount of underfire and overfire air. Typically overfire air is supplied at comparatively high pressures in the order of two to thirty inches of water. By increasing the amount of underfire air, the temperature may be increased. By increasing the amount of overfire air, the temperature may be decreased.

Despite efforts to maintain the combustion chamber within the desired operating range, the temperature of the flames of the fire exceed 1,800° F., possibly as high as 2,300° to 2,500° F., and thus have the effect of melting some solid constituents of the refuse which normally would deposit on the side walls of the incinerator as slag. To prevent such slag formation, it has been the common practice in the industry to cool the side walls of the combustion chamber. Such cooling typically has been provided by a system including a set of ducts formed in the side walls of the combustion chamber, above the level of the stoker, to which a low volume of air under low pressure in the order of one inch of water is supplied by means of a constant volume fan. As such air flows through the wall ducts, it cools the walls and then is bled into the combustion chamber usually just below the nozzles introducing overfire combustion air into the chamber without adding significantly to the mixing and combustion control process. The amount of air used to cool the walls is constant. A fixed speed fan and manual damper adjustment are provided. The cooled side walls provide a cooled boundary layer between the combusting products and the refractory side walls of the combustion chamber, above the level of the stoker, causing melted solid particles in the refuse to solidify and thus avoid being deposited on the side walls of the incinerator as slag.

Recently, it has been found that because of the greater use of plastics and other high heat value materials, refuse, in general, has a higher heat value, having the effect of tending to drive the temperature in combustion chambers of the type described above the optimum operating temperature of 1,800° F. Counteracting the tendency to drive the temperatures in the combustion chamber above the optimum operating temperature has necessitated the use of greater volumes of overfire air. To provide such increased volume of air further has necessitated the use of fans having higher operating pressures which are more expensive in that greater pressure requirements increase fan horsepower exponentially. It thus has been found to be desirable to provide an overfire air system for the type of incinerator described which is capable of providing a greater volume of overfire air over a greater operating range without unduly increasing the operating pressure of the fans traditionally used in a system for providing overfire air for the incinerator.

Accordingly, it is the principal object of the present invention to provide an improved overfire air system for an incinerator.

Another object of the present invention is to provide an improved overfire air system for an incinerator capable of providing an increased volume of overfire air.

A further object of the present invention is to provide an improved overfire air system for an incinerator capable of providing greater volumes of overfire air over a greater operating range.

A still further object of the present invention is to provide an improved overfire air system for an incinerator without having to increase the operating pressure of the fans commonly used in conventional overfire air systems.

Another object of the present invention is to provide an improved overfire air system for incinerators capable of providing a volume of overfire air over a greater operating range without correspondingly increasing the capacity of the fan or fans in the system.

Another object of the present invention is to provide an improved overfire air system for an incinerator effective in reducing the optimum combustion chamber temperature sufficient to provide optimum combustion of refuse.

A further object of the present invention is to provide an improved overfire air system for incinerators effective in maintaining the temperature of the combustion chamber within a desired range of temperatures notwithstanding the burning of refuse including a higher constituency of material having comparatively high heat values.

A still further object of the present invention is to provide an improved overfire air system which is operable to cool the side walls of the incinerator to prevent the formation of slag thereon, provide secondary combustion air in the combustion chamber for promoting the burning process and controlling the temperature of the combustion chamber without correspondingly increasing the horsepower capacity of the fans utilized in the system for producing the volumes of air required to perform such functions.

Another object of the present invention is to provide an improved overfire air system for an incinerator which is effective in providing high combustion efficiency (i.e., low CO and reduced NO formation) at lower overfire air levels caused by low BTU waste.

Other objects and advantages of the present invention will become more apparent to those persons having ordinary skill in the art to which the present invention relates from the following description taken in conjunction with the accompanying drawings wherein.

Figure 1:
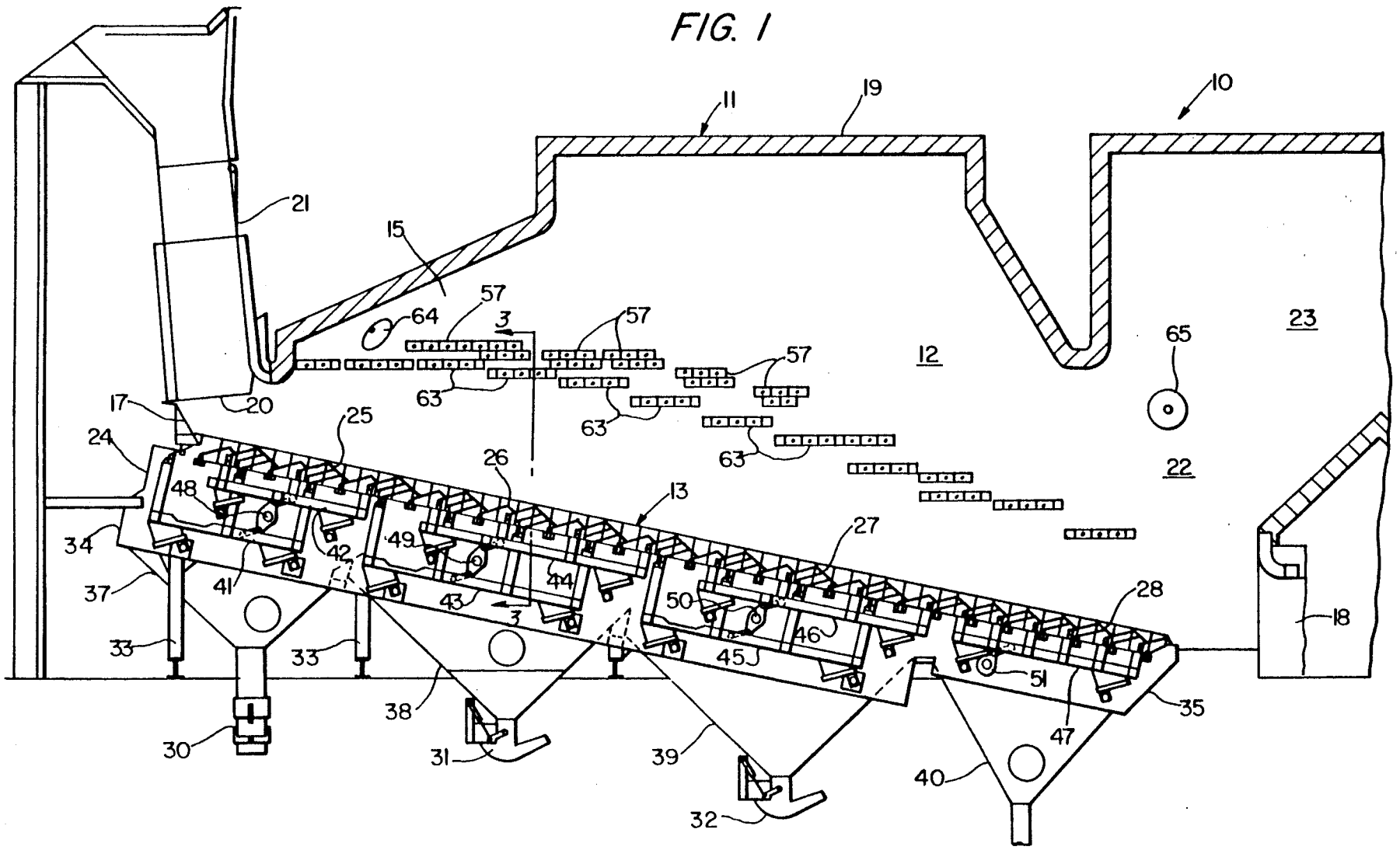
FIG. 1 is a vertical, side cross-sectional view of an incinerator embodying the present invention.
Figure 2:
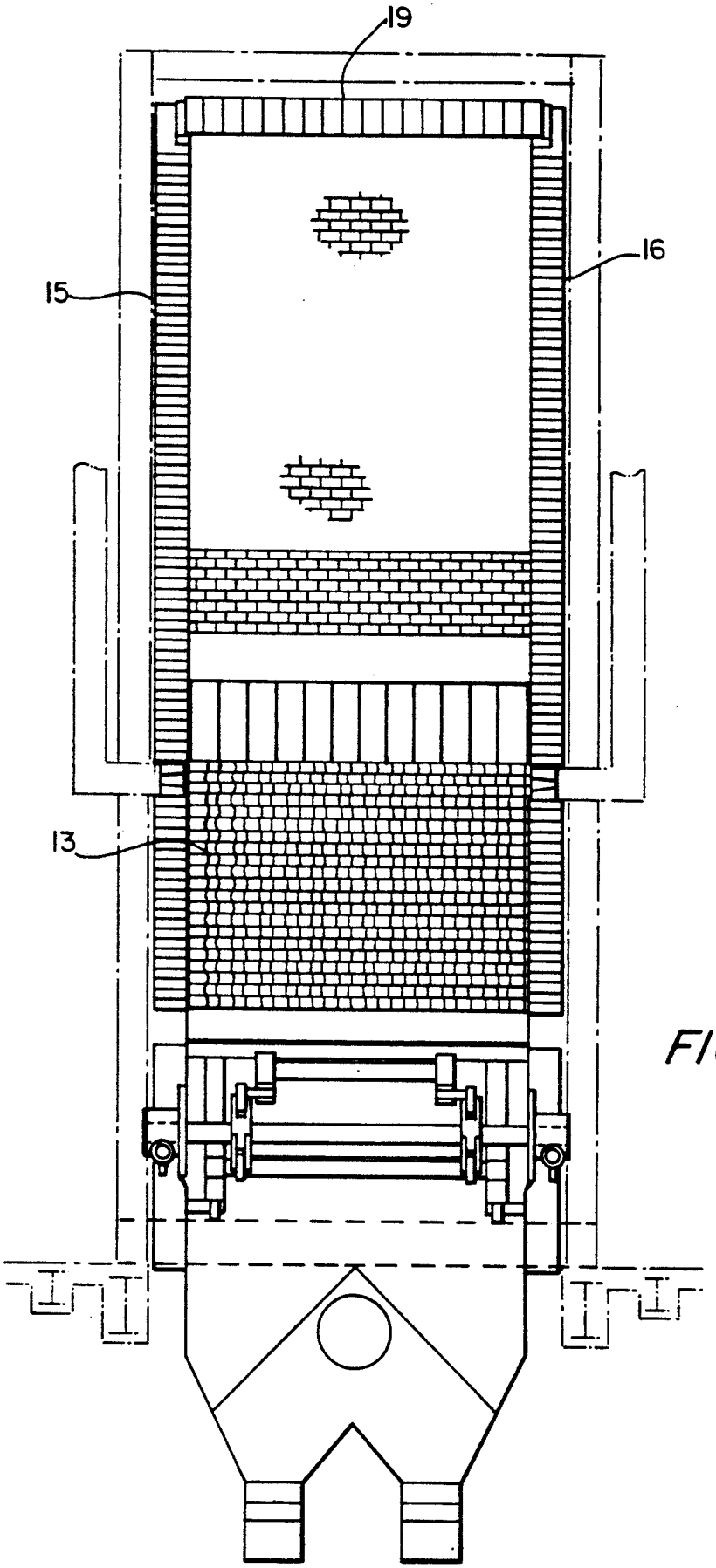
FIG. 2 is a front cross-sectional view of the stoker utilized in the incinerator shown in FIG. 1, having a portion thereof broken away.

Referring to the drawings, there is illustrated an incinerator 10 including a housing 11 defining a combustion chamber 12, a stoker 13 disposed within the combustion chamber and an overfire air system 14 embodying the present invention mounted on the housing structure and operatively connected to the combustion chamber. As best shown in FIGS. 1 and 2, the housing structure is provided with a pair of side walls 15 and 16, a pair of end walls 17 and 18 and a top wall 19. The side walls generally are formed of a refractory material for withstanding the temperatures generated in the combustion chamber, and partially are formed of a good heat conducting material such as silicon carbide for reasons as will later be described. The upper wall of the housing structure is provided with an inlet 20 communicating with a refuse charging chute 21, and end wall 18 is provided with an outlet 22 communicating with a secondary combustion chamber 23.

Stoker 13 is of a type generally as illustrated and described in U.S. Pat. No. 4,913,067. It includes a housing 24, a set of grate units 25 through 28 mounted on the housing, a drive system 29 mounted on the housing and operatively connected to the grate units and ash extractor units 30 through 32.

Housing 24 is supported on a set of structural member 33 and includes a rear wall 34, a front wall 35 and a pair of side walls 36, 36. The lower portion of the housing is provided with a set of hopper sections 37 through 40 defining plenum chambers through which underfire air is supplied to the grate units and which further function to guide siftings from the grate units to the ash extractor units mounted on the lower ends of the funnel sections.

Grate unit 25 consists of an assembly of longitudinally spaced sets of stationary grates supported on cross beams mounted on housing side walls 36, 36, an assembly of longitudinally spaced set of grates disposed in a first alternate set of spaces between the stationary grates supported on a carriage 41 and an assembly of longitudinally spaced sets of grates disposed in a second alternate set of spaces between the stationary grates and supported on a carriage 42. Carriages 41 and 42 are supported on cross beam members rigidly secured to the housing side walls and are adapted to reciprocate relative to each other to correspondingly reciprocate the moveable sets of grates of unit 25 relative to each other and to the sets of stationary grates.

Grate unit 26 is similar in construction and operation to grate unit 25 and includes an assembly of longitudinally spaced sets of stationary grates supported on cross beams rigidly mounted on housing side walls 36, 36, an assembly of longitudinally spaced sets of grates disposed in a first alternate set of spaces disposed in a first alternate set of spaces between sets of stationary grates and supported on a carriage 43 and an assembly of longitudinally spaced sets of grates disposed in a second set of alternate spaces between sets of stationary grates and supported on a carriage 44. Carriages 43 and 44 are supported on cross beams rigidly mounted on the housing side walls and are adapted to reciprocate relative to each other to correspondingly reciprocate the moveable sets of grates relative to each other and to the sets of stationary grates of unit 26.

Grate unit 27 also is similar in construction and operation to grate unit 25 and includes an assembly of longitudinally spaced sets of stationary grates supported on cross beams rigidly mounted on the housing side walls, an assembly of longitudinally spaced sets of grates disposed in a first alternate set of spaces between sets of stationary grates and supported on a carriage 45 and an assembly of longitudinally spaced sets of grates disposed in a second set of alternate spaces between sets of stationary grates and supported on a carriage 46. Carriages 45 and 46 are supported on cross beams rigidly mounted on the housing side walls and are adapted to reciprocate relative to each other to correspondingly reciprocate the moveable sets of grates relative to each other and to the sets of stationary grates of unit 27.

Grate unit 28 includes an assembly of longitudinally spaced sets of stationary grates supported on cross beam members rigidly mounted on the housing side walls, and an assembly of longitudinally spaced sets of movable grates disposed in spaces between sets of stationary grates and supported on a carriage 47. Carriage 47 is supported on cross beam members rigidly mounted on the housing side walls and is adapted to reciprocate to correspondingly reciprocate the moveable set of grates relative to the sets of stationary grates of unit 28.

Drive system 29 includes a set of pivot shafts 48 through 51 each journaled in the housing side walls and a set of crank arms mounted thereon which are connected by links to carriages 41 through 47. The pivot shafts are operatively connected through crank arm mechanisms with one or more hydraulic cylinder assemblies which are operated to extend and retract and correspondingly reciprocate the carriages thus providing a stoking action on refuse deposited on the stoker.

Figure 3:
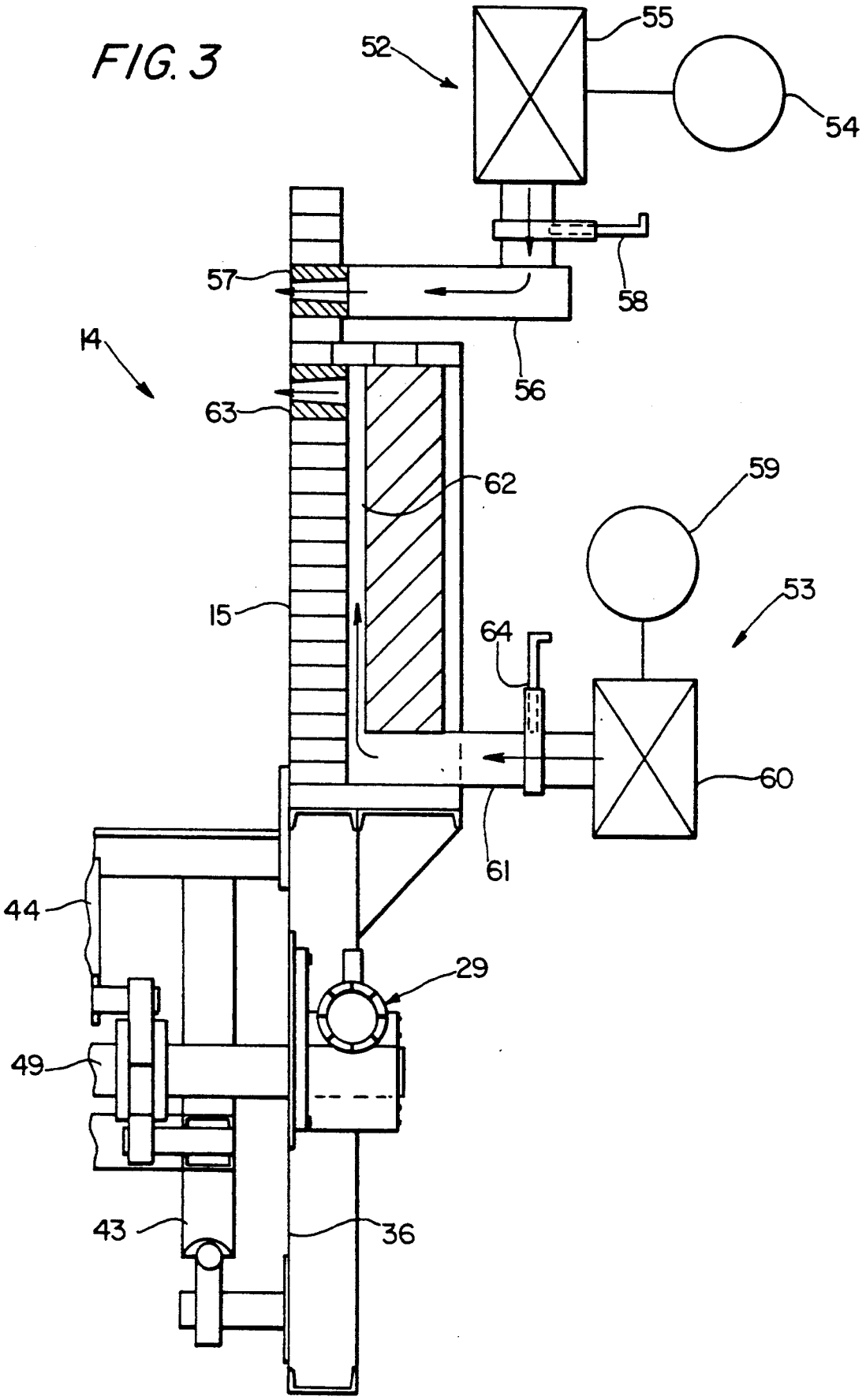
FIG. 3 is an enlarged, cross-sectional view taken along line 3—3 in FIG. 1.

Referring to FIG. 3, overfire air supply system 14 is illustrated diagrammatically. The system includes a set of subsystems 52 and 53 which service one side of the incinerator. Subsystem 52 is comparable to a conventional overfire air supply system and includes a variable volume fan 54 having a capacity of 25,000 CFM, a header 55, a plurality of feeder ducts 56 and a plurality of overfire air nozzles 57. Fan 54 functions to provide a variable volume of air in the range of 0 to 25,000 CFM to header 55 which functions to supply such volumes of air through feeder ducts 56 and nozzles 57 into the combustion chamber above the stoker grates. A manual damper 58 further is provided to control the flow of air to different sets of nozzles. Subsystem 53 similarly includes a variable volume fan 59 having a capacity of 25,000 CFM, a header 60, a plurality of feeder ducts 61, a plurality of vertically disposed ducts 62 formed in the side wall of the incinerator above the level of the stoker grates and a plurality of nozzles 63 disposed adjacent and just below nozzles 57. Fan 59 functions to provide a variable volume of air in the range of 0 to 25,000 CFM to header 60 which functions to distribute the air through feeder ducts 61, wall ducts 62 and nozzles 63 into the combustion chamber. The feeder headers further are provided with manual dampers 64.

Subsystem 52 of the overfire air supply system functions in the conventional manner to supply a variable volume of air into the combustion chamber. Nozzles 57 are sized so that the stream of air injected into the combustion chamber will penetrate not less than 50% of the width of the combustion chamber. Such penetration will not only provide secondary combustion air but also will mix this air with the combustible gases emanating from the burning refuse to enhance the combustion process. Subsystem 53 functions not only to cool the side wall of the incinerator in the conventional manner but further cooperates with subsystem 52 to provide an additional source of overfire air. In conventional systems, subsystem 53 would function only to supply a low volume of cooling air at a low pressure in wall ducts 62 to cool the side walls and then allow the constant volume of air to be bled into the combustion chamber. Subsystem 53 not only functions to cool the side wall of the incinerator above the level of stoker grates to provide a boundary layer of cool air along the sides of the incinerator to prevent the deposit of molten slag on the incinerator side walls but further functions to inject streams of overfire air through nozzles 63 into the combustion chamber to complement the air supply through nozzles 57 for further supplying secondary combustion air to enhance the combustion process. By the use of the two systems, the total volume of overfire air and the range over which such air may be supplied is increased without having to resort to the use of higher pressure fans with exponentially larger horsepower requirements. By the operation of the two subsystems in parallel, the maximum volume of overfire air available to be supplied to the combustion chamber is increased to 50,000 CFM and the amount may be varied in the range of 10,000 to 50,000 CFM by operation of fans 54 and 59 at different speeds.

The side walls of the incinerator between the stoker grates and nozzles 63 are formed of a refractory material having good heat exchange properties such as silicon carbide to allow the formation of a cool boundary layer along the length thereof to protect the side wall from slag formation. The side wall of the incinerator above nozzles 63 may be formed of any suitable refractory such as high alumina fire brick.

In the operation of the incinerator as described, refuse is charged onto the upper end of the stoker through charging chute 21. Burners 64 are operated to preheat the incinerator, ignite the refuse when first fed onto the stoker, and to assist in drying low BTU refuse while maintaining the minimum allowable furnace outlet temperature during adverse burning conditions. Periodically, the drive system is operated to advance the dried burning refuse to grate units 26 and 27 where the principal combustion of the refuse occurs. As the drive system of the stoker is operated further, the burned refuse advances to grate unit 28 where it is burned down. The ash residue then is discharged off of the lower end of the stoker into a pit where a conveyor removes it from the incinerator. Products of combustion generated by the combustion process flow through outlet 22 and pass a burner 65 in secondary combustion chamber 23. The secondary burner 65 is used to preheat the secondary chamber 23 during start-up before waste is charged into the furnace 12 and during adverse burning conditions when more heat is required than can be supplied by primary burner 64. Such products of combustion may be treated further or discharged through a flue in the conventional manner. Siftings falling between the grates into the hopper sections are guided downwardly into the ash extractor units which function in the conventional manner to discharge such siftings from the incinerator.

In the course of the combustion process, an underfire air system supplies underfire air to the underside of the stoker grates, and overfire air system 14 supplies overfire air to the combustion chamber above the stoker grates. By regulating the amounts of overfire and underfire air, the temperature in the combustion chamber is maintained at or near setpoint temperature of 1,875° F. to provide optimum burning conditions Whenever the combustion chamber temperature falls below 1,875° F., the volume of underfire air may be increased and the volume of overfire air may be decreased to increase the combustion chamber temperature. Conversely, whenever the combustion chamber temperature exceeds the optimum temperature of 1,875° F., the volume of overfire air may be increased and the volume of underfire air may be decreased to drive the temperature down.

Whenever the refuse charged into the incinerator may include constituents having high heat values tending to drive the combustion chamber temperature well above the optimum combustion chamber temperature, the system as described will function to provide the necessary amount of increased overfire air to drive the combustion chamber down to within acceptable limits. This is made possible by the use of the two subsystems 52 and 53 in parallel which has not been available in prior art incinerators without resort to larger capacity fans for conventional overfire air supply systems. The overfire air system as described not only effectively cools the side walls of the incinerator to prevent the formation of slag on the side walls but also is capable of providing a larger volume of overfire air to cool the combustion chamber without having to resort to larger fans for producing higher volumes of air. The system as described further is advantageous in that fans 54 and 59 can be of a same type and nozzles 57 and 63 similarly can be of a same type thus reducing the number of replaceable parts to be available at the facility.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. In an incinerator having a housing structure defining a combustion chamber provided with a pair of side walls, a stoker disposed in said combustion chamber between said side walls and an underfire air system, an overfire air system comprising:

first means for injecting a variable volume of air under pressure from a first source into said combustion chamber at a level above said stoker, and second means for injecting a variable volume of air under pressure from a second source separate from said first source into said combustion chamber at a level above said stoker, said second variable volume air injecting means including means for conveying air supplied to said combustion chamber in heat exchange relation with at least one side wall of said combustion chamber for cooling said wall.

2. A system according to claim 1 wherein said first variable volume air injecting means includes a set of nozzles disposed in said side wall for directing streams of air into said combustion chamber.

3. A system according to claim 2 wherein said set of nozzles are sized to inject streams of air at least one-half of the width of said combustion chamber.

4. A system according to claim 2 wherein said first variable volume air injecting means includes a variable volume fan.

5. A system according to claim 4 wherein said variable volume fan is operable to produce a volume of air flow in the range of 0 to 25,000 CFM.

6. A system according to claim 1 wherein said second variable volume air injecting means includes a set of nozzles disposed in said side walls directing streams of air into said combustion chamber.

7. A system according to claim 6 wherein said set of nozzles are sized to inject streams of air at least one-half the width of said combustion chamber.

8. A system according to claim 6 wherein said second variable volume air injecting means includes a variable volume fan.

9. A system according to claim 8 wherein said variable volume fan is operable to produce a volume of air flow in the range of 0 to 25,000 CFM.

10. A system according to claim 6 wherein said second variable volume air injecting means includes a set of ducts disposed in said side wall.

11. A system according to claim 1 wherein said first variable volume air injecting means a first set of nozzles disposed in said side wall for directing streams of air into said combustion chamber and said second variable volume air injection means include as a second set of nozzles disposed in said side walls below and adjacent said first set of nozzles for directing streams of air into said combustion chamber.

12. A system according to claim 11 wherein each of said means for injecting variable volumes of air into said combustion chamber includes a variable volume fans.

13. A system according to claim 12 wherein each of said variable volume fans is operable to produce an air flow in the range of 0 to 25,000 CFM for a combined range of 0 to 50,000 CFM.

14. A system according to claim 12 wherein said second variable volume air injecting means includes a set of ducts disposed in said side wall.

15. A system according to claim 10 wherein said set of ducts are disposed in a wall formed of a high heat conductive material.

16. A system according to claim 15 wherein said material is silicon carbide.

* * * * *

UNITED STATES PATENT AND TRADEMARK OFFICE

CERTIFICATE OF CORRECTION

PATENT NO. : 5,323,718

DATED : June 28, 1994

INVENTOR(S) : Charles J. SCOLARO & Matthew J. Gaskin

It is certified that error appears in the above-identified patent and that said Letters Patent is hereby corrected as shown below:

Claim 11, column 8, line 8, after "means" insert --includes--;

line 11, delete "include as" and insert therefor --includes--;

Claim 12, column 8, line 17, delete "fans" and insert therefor --fan--.

Signed and Sealed this

First Day of November, 1994

*Attest:*

*Attesting Officer*

Bruce Lehman

BRUCE LEHMAN

*Commissioner of Patents and Trademarks*